US007221113B1

(12) United States Patent
Young et al.

(10) Patent No.: US 7,221,113 B1
(45) Date of Patent: May 22, 2007

(54) TOUCH-SENSITIVE MODEL TRAIN CONTROLS

(75) Inventors: Neil Young, Redwood City, CA (US); Louis G. Kovach, II, Belleville, MI (US)

(73) Assignee: The Creative Train Company, LLC, Beverly Hills, CA (US)

( * ) Notice: Subject to any disclaimer, the term of this patent is extended or adjusted under 35 U.S.C. 154(b) by 0 days.

(21) Appl. No.: 10/986,459

(22) Filed: Nov. 10, 2004

(51) Int. Cl.
*B60K 6/04* (2006.01)

(52) U.S. Cl. ..... 318/9; 318/3; 446/467; 446/410; 446/465

(58) Field of Classification Search ..... 446/467, 446/410, 465; 318/3, 9
See application file for complete search history.

(56) References Cited

U.S. PATENT DOCUMENTS

| | | | | |
|---|---|---|---|---|
| 2,826,996 | A * | 3/1958 | Smith | 104/296 |
| 3,664,060 | A * | 5/1972 | Longnecker | 446/410 |
| 4,293,851 | A | 10/1981 | Beyl | |
| 4,468,999 | A | 9/1984 | Bonanno | |
| 4,489,302 | A | 12/1984 | Eventoff | |
| 5,115,705 | A | 5/1992 | Monte et al. | |
| 5,302,936 | A | 4/1994 | Yaniger | |
| 5,555,815 | A * | 9/1996 | Young et al. | 104/296 |
| 5,659,334 | A | 8/1997 | Yaniger et al. | |
| 5,754,094 | A | 5/1998 | Frushour | |
| 5,805,144 | A | 9/1998 | Scholder et al. | |
| 5,896,017 | A | 4/1999 | Severson et al. | |
| 6,010,339 | A * | 1/2000 | McDonald | 434/258 |
| 6,019,289 | A | 2/2000 | Sung | |
| 6,059,237 | A * | 5/2000 | Choi | 246/192 A |
| 6,198,473 | B1 | 3/2001 | Armstrong | |
| 6,220,552 | B1 | 4/2001 | Ireland | |
| 6,275,739 | B1 | 8/2001 | Ireland | |
| 6,281,606 | B1 | 8/2001 | Westlake | |
| 6,318,678 | B2 | 11/2001 | Ireland | |
| 6,367,742 | B1 | 4/2002 | Ireland | |
| 6,390,883 | B1 * | 5/2002 | Choi | 446/436 |

(Continued)

OTHER PUBLICATIONS

"Astrac lets you control 5 trains on one track, in different directions, at different speeds-simultaneously," product advertisement from General Electric Corporation in Model Railroader magazine (Nov. 1963).

(Continued)

*Primary Examiner*—Rina Duda
(74) *Attorney, Agent, or Firm*—O'Melveny & Myers LLP

(57) ABSTRACT

A model vehicle control apparatus. A button controls an aspect of the model vehicle system, or multiple aspects, such as both sound and control. The button is configured to provide more than two outputs depending upon the manner of activation by a user based on pressure or position (more than ON/OFF). Signals corresponding to those outputs are then transmitted to a model vehicle, accessory, or other apparatus in the system. In one embodiment, the button is a pressure-sensitive button. Variations in the pressure select among multiple different possible outputs. For example, a number of sounds can be stored in a memory, with varying pressures selecting different sounds to be played. These sounds can vary non-linearly, not just getting louder, but also changing in type, pitch, etc. Thus, by a variation in pressure, a user can play the sound like a musical instrument. A second embodiment would allow for control of speed and direction of model vehicle, engines and accessories.

29 Claims, 2 Drawing Sheets

U.S. PATENT DOCUMENTS

| | | | | |
|---|---|---|---|---|
| 6,441,570 | B1 | 8/2002 | Grubba et al. | |
| 6,457,681 | B1 | 10/2002 | Wolf et al. | |
| 6,485,347 | B1 | 11/2002 | Grubba et al. | |
| 6,491,263 | B1 | 12/2002 | Sung et al. | |
| 6,513,763 | B1 | 2/2003 | Ireland | |
| 6,533,223 | B1 | 3/2003 | Ireland | |
| 6,533,224 | B1 | 3/2003 | Ireland | |
| 6,536,716 | B1 | 3/2003 | Ireland et al. | |
| 6,539,292 | B1 | 3/2003 | Ames | |
| 6,545,886 | B1 | 4/2003 | Ireland | |
| 6,604,641 | B2 | 8/2003 | Wolf et al. | |
| 6,619,594 | B2 | 9/2003 | Wolf et al. | |
| 6,624,537 | B2 | 9/2003 | Westlake | |
| 6,655,640 | B2 | 12/2003 | Wolf et al. | |
| 6,662,917 | B1 | 12/2003 | Wolf et al. | |
| 6,729,584 | B2 | 5/2004 | Ireland | |
| 6,747,579 | B1 * | 6/2004 | Ireland | 341/34 |
| 6,765,356 | B1 | 7/2004 | Denen et al. | |
| 2001/0005001 | A1 | 6/2001 | Ireland | |
| 2003/0015626 | A1 | 1/2003 | Wolf et al. | |
| 2003/0127570 | A1 | 7/2003 | Ireland | |
| 2003/0142796 | A1 | 7/2003 | Ames | |
| 2004/0079841 | A1 | 4/2004 | Wolf et al. | |
| 2004/0239268 | A1 | 12/2004 | Grubba et al. | |
| 2005/0023416 | A1 | 2/2005 | Wolf et al. | |

OTHER PUBLICATIONS

"DCC (Digital Command Control) Standards & Recommended Practices," National Model Railroad Association, Inc. (Mar. 1997-Jul. 2004).
"FSR® Force Sensing Resistors®" product data sheet Interlink Electronics, Inc. Camarillo, CA (2002).
Gutierrez "Introducing the CTC-16: A 16-channel command control system you can build Part 1," Model Railroader pp. 64-67 (Dec. 1997).
Gutierrez "The CTC-16: A 16-channel command control system you can build Part 2," Model Railroader pp. 86-93 (Jan. 1980).
Gutierrez "The CTC-16: A 16-channel command control system you can build Part 3," Model Railroader pp. 89-92 (Feb. 1980).
Gutierrez "The CTC-16: A 16-channel command control system you can build Part 4," Model Railroader pp. 89-93 (Mar. 1980).
Gutierrez "The CTC-16: A 16-channel command control system you can build Part 5," Model Railroader pp. 71-77 (Apr. 1980).
Gutierrez et al., "The CTC-16: epilogue," Model Railroader pp. 132-136 (Dec. 1980).
Gutierrez "Build the wireless throttle 1," Model Railroader pp. 86-95 (Mar. 1983).
Gutierrez "Build the wireless throttle 2," Model Railroader pp. 68-75 (Apr. 1983).
"Infrared Control Unit," Model Railroader pp. 54-56 (Mar. 1991).
Pussel µP-programmable speed controller for model railways, Elektor (Jul./Aug. 1979).
Sperandeo "Commercial Command Control Systems," Model Railroader pp. 80-81 (Nov. 1979).
Westcott "Is Astrac on the right track?" Model Railroader pp. 33-37 (Dec. 1963).
Wigmore "The Digital Model Train Part 1 ," Elektor Electronics pp. 42-46 (Feb. 1989).
Wigmore "The Digital Model Train Part 2 ," Elektor Electronics pp. 50-53 (Mar. 1989).
Wigmore "The Digital Model Train Part 3 ," Elektor Electronics pp. 14-18 (Apr. 1989).
Wigmore "The Digital Model Train Part 4 ," Elektor Electronics pp. 16-17 (May 1989).
Wigmore "The Digital Model Train Part 5 ," Elektor Electronics pp. 56-59 (Jul./Aug. 1989).
Wigmore "The Digital Model Train Part 6 ," Elektor Electronics pp. 44-47 (Sep. 1989).
Wigmore "The Digital Model Train Part 7 ," Elektor Electronics pp. 21-24 (Oct. 1989).
Wigmore "The Digital Model Train Part 8 ," Elektor Electronics pp. 32-36 (Nov. 1989).
Wigmore "The Digital Model Train Part 9—Keyboards ," Elektor Eletronics pp. 24-28 (Dec. 1989).
Wigmore "The Digital Model Train Part 10—RS232 Interface," Elektor Electronics pp. 38-43 (Jan. 1990).
Wigmore "The Digital Model Train Part 11—The Monotor Unit," Elektor Electronics pp. 53-55 (Feb. 1990).
Wigmore "The Digital Model Train Part 12—Address Display," Elektor Electronics pp. 52-54 (Mar. 1990).
Wigmore "The Digital Model Train Concluding Part," Elektor Electronics pp. 24-26 (Apr. 1990).

* cited by examiner

TOUCH-SENSITIVE MODEL TRAIN CONTROLS

CROSS-REFERENCES TO RELATED APPLICATIONS

NOT APPLICABLE

STATEMENT AS TO RIGHTS TO INVENTIONS MADE UNDER FEDERALLY SPONSORED RESEARCH OR DEVELOPMENT

NOT APPLICABLE

REFERENCE TO A "SEQUENCE LISTING," A TABLE, OR A COMPUTER PROGRAM LISTING APPENDIX SUBMITTED ON A COMPACT DISK

NOT APPLICABLE

BACKGROUND OF THE INVENTION

The present invention relates to control systems for model vehicles, in particular, model trains, and more particularly to variable control using a single button.

A typical model train controller includes a throttle, which may be in the form of a dial, a slider or a rotating arm. The controller will typically have a series of buttons that can activate a brake, boost, change of direction, bell, and a whistle or horn. Different sounds can be stored and replayed automatically upon the activation of either of the bell, brake, throttle, or whistle/horn button. An example of a patent illustrating different model train sounds is U.S. Pat. No. 4,293,851. U.S. Pat. No. 5,754,094 shows multiple sounds stored in the memory with their selection being based up the speed of the train. Other patents describing train sounds include U.S. Pat. No. 5,896,017 and U.S. Pat. No. 6,457,681.

A system for horn/whistle control was contemplated in the LIONEL trainmaster system, where two horn commands were supplied in the protocol to trigger two different horn/whistle sounds. The control was expected to use either a two position switch or two separate switches. The controller for this feature was never developed.

In the area of music keyboards, pressure-sensitive keys can be used to reproduce desired music. For example, see U.S. Pat. No. 4,468,999 or U.S. Pat. No. 5,115,705.

In other technology areas, such as computer peripherals, pressure-sensitive buttons that do not move significantly, but rather are slightly depressed, are used.

Some mice and other input devices also include force-sensitive inputs. Interlink U.S. Pat. No. 5,659,334 shows a microstick mounted on a Force Sensing Resistor® (a registered trademark of Interlink Electronics).

U.S. Pat. No. 5,805,144 shows a mouse with an integrated touchpad. The touchpad can include an elongated portion which acts as a slide-bar, allowing analog control. The touchpad can also detect varying pressure to provide another input dimension.

U.S. Pat. No. 6,198,473, issued to inventor Brad Armstrong, shows a computer mouse with a pressure-sensitive depressible button. The button can be used to provide scrolling, with the speed of the scrolling varying with the applied pressure. The button is an elastomeric dome-cap button in which the dome-cap collapses to come in contact with a compressible, partially conductive element, which is a carbon in an elastomeric or rubber binder. The more pressure applied to the conductive element, the more electricity it will conduct.

One type of pressure-sensitive input element is a resistor which senses force, such as the Force Sensing Resistor® force-sensitive resistor (FSR®) available from Interlink Electronics. Such a force-sensitive resistor typically includes two conductors mounted on spaced apart substrates, with the substrates being compressed to close the gap and provide contact between the conductors. The signal output varies in accordance with the area of contact. An example is set forth in Interlink U.S. Pat. No. 5,302,936. Interlink advertises use of such input elements on remote controls for TVs, PC products and videoconferencing systems. They are also used for mice and keyboards.

Another pressure-sensitive force transducer is described in U.S. Pat. No. 4,489,302.

BRIEF SUMMARY OF THE INVENTION

The present invention provides a model vehicle control apparatus. A button controls an aspect of the model vehicle system. The button is configured to provide more than two outputs depending upon the manner of activation by a user (more than ON/OFF). Signals corresponding to those outputs are then transmitted to a model vehicle, accessory, or other apparatus in the system.

In one embodiment, the button is a pressure-sensitive button. Variations in the pressure select among multiple different possible outputs. For example, a number of sounds can be stored in a memory, with varying pressures selecting different sounds to be played. These sounds can vary non-linearly, not just getting louder, but also changing in type, pitch, etc. Thus, by a variation in pressure, a user can play the sound like a musical instrument. Other buttons could be used, rather than a pressure sensitive button, such as a rocker button, 4-way button, slider, touch pad, etc.

In another embodiment, a pressure-sensitive button controls boost, braking, throttle, or other aspects of a model vehicle control system, in particular, a model train system. The same button can be used to both vary boost, etc. and also to correspondingly vary the sound. For example, a brake pressure button could change both speed and the sound.

For a further understanding of the nature and advantages of the invention, reference should be made to the following description in conjunction with the accompanying drawings.

DETAILED DESCRIPTION OF THE INVENTION

Example Control System

Figure 1:
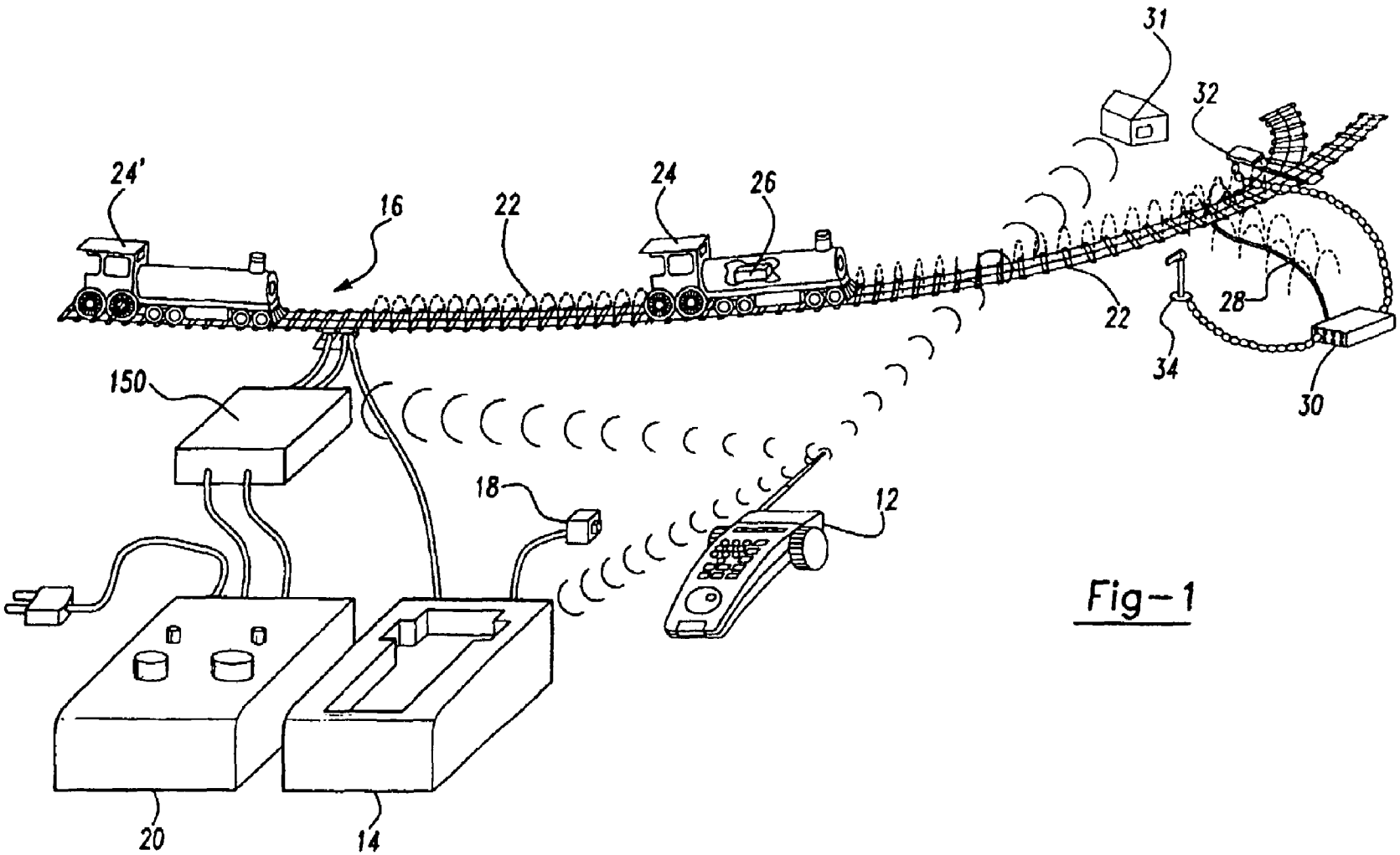
FIG. 1 is a diagram of an example model train control system in which the present invention could be used.

FIG. 1 is a perspective drawing of an example layout of a train track system. A hand-held remote control unit 12 is used to transmit signals to a base unit 14 and to a power master unit 150 both of which are connected to train tracks 16. Base unit 14 receives power through an AC adapter 18.

A separate transformer 20 is connected to track 16 to apply power to the tracks through power master unit 150. Power master unit 150 is used to control the delivery of power to the track 16 and also is used to superimpose DC control signals on the AC power signal upon request by command signals from the hand-held remote control unit 12.

Base unit 14 transmits an RF signal between the track and earth ground, which generates an electromagnetic field indicated by lines 22 which propagates along the track. This field will pass through a locomotive 24 and will be received by a receiver 26 inside the locomotive. Locomotive 24 may be, e.g., a standard locomotive retrofitted or designed to carry a special receiver 26. Alternate systems of communicating with a train could also be used.

The electromagnetic field generated by base unit 14 will also propagate along a line 28 to a switch controller 30. Switch controller 30 also has a receiver in it, and will itself transmit control signals to various devices, such as the track switching module 32 or a moving flag 34.

The remote unit can transmit commands wirelessly to base unit 14, power master unit 150, accessories such as accessory 31, and could transmit directly to train engines instead of through the tracks. Such a transmission directly to the train engine could be used for newer engines with a wireless receiver, while older train engines would continue to receive commands through the tracks. Both the accessories and the trains may include speakers for generating sounds.

Remote Control Unit

Figure 2:
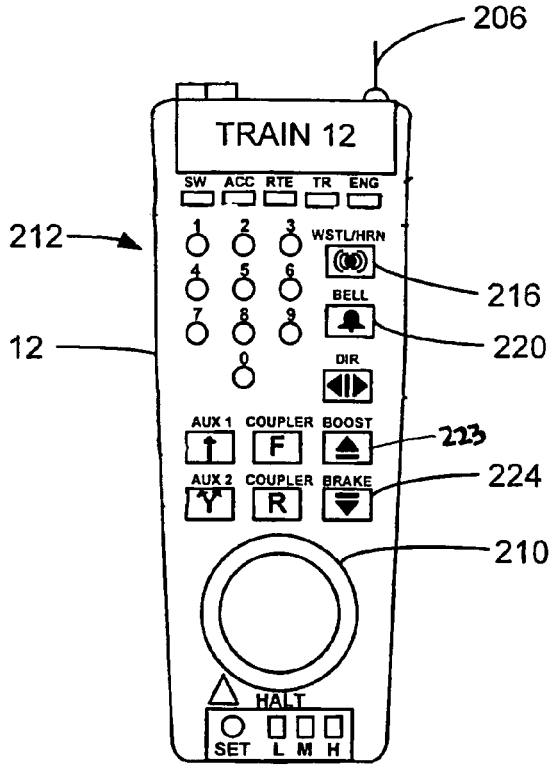
FIG. 2 is a diagram of a remote control for a model train system incorporating pressure-sensitive buttons according to an embodiment of the present invention.

FIG. 2 is a diagram of a remote control unit incorporating an embodiment of the present invention. The remote control unit 212 includes an antenna 206 for transmitting to a remote train engine, accessory, or base unit. A pressure-sensitive pad 210 is used to control the throttle or speed of the train engine. A pressure-sensitive button 216 controls the whistle or horn. A pressure-sensitive button 220 controls the bell. A pressure-sensitive button 223 controls the boost. A pressure-sensitive button 224 controls the brake. The remaining buttons on the remote control unit could be normal buttons, or could also be pressure-sensitive buttons. Alternately, only one or some of the mentioned buttons could be touch or pressure sensitive.

In alternate embodiments, instead of a pressure sensitive button, other methods of creating multiple outputs (more than ON/OFF) from a single button may be used. Examples include a slider button or a slider "soft key" area of a touch screen. Alternately, in another embodiment, instead of a remote control, a stationary control device directly hard-wired to the train layout could be used.

Touch-Sensitive Dynamic Whistle/Horn

Horn/whistle recordings are made with different levels of intensity and volume. For example, a five chime horn may come in five harmonic levels, each one with another chime added, plus three or more levels in which all five chimes get louder and have different endings. Horns and whistles may be recorded in different levels. Any number of levels of horn/whistle intensity could be used. In one embodiment, gently touching the button achieves a level 1 sound of one chime softly. Increasing pressure from the user will trigger chimes 2, 3, 4, and 5 until the complete five-chime chord is heard from the horn. More pressure results in more loudness of the five-chime horn. The maximum pressure to the button achieves the loudest horn sound available with all five chimes. The pressure input control can not only control loudness, but also how the different sound records are mixed.

Releasing the pressure sensitive button will play an "end horn/whistle" sound which could be different for each level of chime and each level of five chime loudness. The end sound will be different depending upon both volume and which records are mixed to form the ending. This provides a horn/whistle that a user can "play" like a musical instrument, similar to the way engineers do on real railroads, and musicians do with pressure sensitive keyboards. Because the pressure sensitive button has high resolution, by varying the pressure applied to the button, the user can control the sound of the horn in real time, applying the correct amount of pressure to get the desired result. The touch sensitive button approach is unique because it allows many different expressions, proportionally, in real time, based on the input of the user, Touch-Sensitive Boost Button In one embodiment, the boost button is implemented as a touch-sensitive button. Pushing the button hard accelerates the train from its existing speed quickly to top speed with a loud "rpm upramp" or series of upramp sounds. Releasing the button causes a "rpm downramp" sound, or appropriate other sound. Touching the button lightly at speed accelerates the train slightly while an rpm upramp sound is heard. Releasing the button causes an "rpm downramp" sound.

As there can be high resolution from the button, the response of the train, vehicle and sounds can be controlled precisely by applying the correct amount of pressure to achieve the desired boosting speed. By utilizing the pressure sensitive button, a controlled return to speed+1 (or any other desired speed) can actually be achieved. The rate of acceleration/deceleration with corresponding sounds can be driven by same button.

Current boost control buttons rely on programs in the train or controller to model the acceleration of the train. Current boost buttons typically repeat the same boost and brake commands every 100 to 200 ms. It is hard to predict exactly what rate of acceleration the train will attain, or how it will return back to speed once the button is released. The touch sensitive approach allows for direct user control, in real time, giving more accuracy and the feeling of a dynamic interaction between the user and the model.

The added bonus of being able to trigger rpm sounds with dynamic timing and intensity simultaneously with speed control only adds to the rewards of the touch sensitive approach to speed control. When used in conjunction with a velocity controlled throttle, the touch sensitive boost button provides a unique "in touch" feeling between the user and the model.

Touch Sensitive Brake Button

In one embodiment, the brake button is touch sensitive. Pushing the button hard stops the train quickly with a loud screeching brake sound. Releasing the button causes a "brake release" sound, and the train stays stopped. Touching the button lightly at speed slows the train slightly while a brake sound is heard.

As there can be high resolution from the button, the response of the train can be controlled precisely by applying the correct amount of pressure to achieve the desired braking speed. By utilizing the pressure sensitive button, a slow stop at a definite target can actually be achieved. Using the pressure sensitive method a sense of user urgency could measure and apply to the model train, giving a more realistic experience.

Current brake control buttons rely on programs in the train or controller to model the braking of the train. It is hard to predict exactly where the train will stop and these programs have no sense of how quickly or slowly the operator wants to stop. The touch sensitive approach allows for direct user control, in real time, giving more accuracy and the feeling of a dynamic interaction between the user and the model.

The added bonus of being able to trigger brake sounds with dynamic intensity only adds to the rewards of the touch sensitive approach to speed control. When used in conjunction with the throttle, the touch sensitive brake provides a unique "in touch" feeling between the user and the model.

Electronic Circuitry

Figure 3:
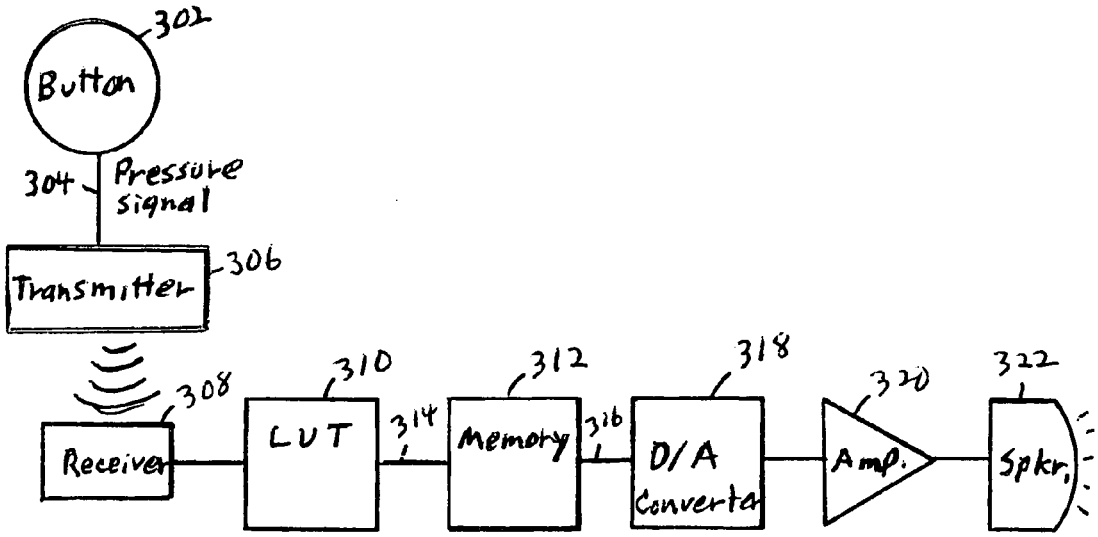
FIG. 3 is a diagram of the electronics of an embodiment of the present invention.

FIG. 3 illustrates one embodiment of electronic circuitry implementing the present invention. A pressure-sensitive button 302 on a remote provides an output, for controlling an aspect of a model vehicle, on line 304 corresponding to the pressure applied. This may be an analog or digital signal. An example of a suitable button would be a Force Sensing Resistor provided by Interlink as described in the background, above.

The value on line 304 can be provided to a transmitter 306 which transmits to a receiver 308 in a train, in direct mode. Alternately, the transmission can be to a base unit, with retransmission to receiver 308. The transmission could be by RF, infrared (IR), or it could be a transmission over wires without a wireless transmitter and receiver being needed.

The signals from receiver 308 are provided to a look-up table (LUT) 310 that maps the signals to addresses for a memory 312. The mapped addresses are provided on an address input 314 to memory 312, to select an appropriate sound output on an output line 316. This output is then provided to a digital-to-analog converter 318, an optional amplifier 320, and to a loudspeaker 322.

In an alternate embodiment, the mapping to the sound could be done prior to transmission. Additionally, the conversion to analog form could be done prior to transmission as well, limiting the number of components that need to be connected to the speaker. The speaker could be located in a train engine or other train car, any other model vehicle, an accessory (train station, signal light, railroad crossing signal, etc.), or elsewhere on a model vehicle layout.

As will be understood by those of skill in the art, the present invention may be embodied in other specific forms without departing from the essential characteristics thereof. For example, a pressure-sensitive or other type of button could be mounted on a transformer rather than a remote control. Accordingly, the foregoing description is intended to be illustrative, but not limiting, of the scope of the invention which is set forth in the following claims.

What is claimed is:

1. A model vehicle system control apparatus comprising:

a housing;

at least one pressure-sensitive button mounted in said housing for controlling an aspect of said model vehicle system;

said button being configured to provide more than two outputs depending on an amount of pressure applied by a user, said more than two outputs having a non-linear relationship to said amount of pressure applied; and a transmitter, coupled to said button, for transmitting one of a plurality of signals corresponding to one of said more than two outputs.

2. The apparatus of claim 1 wherein said button is an elongated touch sensitive area.

3. The apparatus of claim 1 wherein said button is a resistive slider switch.

4. The apparatus of claim 1 wherein said outputs correspond to different sounds.

5. The apparatus of claim 1 wherein said button is a device that creates an input based on position or pressure.

6. The apparatus of claim 1 wherein a first range of pressure applied to said button varies a first aspect of a control function, and a second range of pressure varies a second aspect of said control function.

7. The apparatus of claim 6 wherein said first aspect is a type of sound and said second aspect is a loudness of a sound.

8. The apparatus of claim 6 wherein said first aspect controls the mixing and record selection of the sounds played.

9. The apparatus of claim 1 wherein a variation of pressure causes a non-linear variation in a function controlled by said button.

10. The apparatus of claim 1 wherein a release of said button by said user causes generation of a control signal to generate a unique sound or control feature.

11. The apparatus of claim 1 wherein said button is pressure-sensitive, and wherein a variation in pressure causes both a variation in sound and a variation in another control function.

12. The apparatus of claim 11 wherein said variation in sound is synchronized with said variation in another control function.

13. A model train system control apparatus comprising:

a housing;

at least one pressure-sensitive button mounted in said housing for controlling an aspect of said model train system;

said button being configured to provide more than two outputs depending on an amount of pressure applied by a user, said two outputs having a non-linear relationship to said amount of pressure, wherein a release of said button by said user causes generation of a control signal to generate a unique sound or control feature; and a transmitter, coupled to said button, for transmitting one of a plurality of signals corresponding to one of said more than two outputs.

14. The apparatus of claim 13 wherein a variation of pressure causes a non-linear variation in a function controlled by said button.

15. A method for operating a model vehicle system control comprising:

controlling an aspect of said model vehicle system with a button;

providing more than two outputs of said button depending on an amount of pressure applied by a user, said two outputs having a non-linear relationship to an amount of pressure applied to said button; and transmitting one of a plurality of signals corresponding to one of said more than two outputs.

16. The method of claim 15 wherein said manner of activation comprises varying a pressure on a pressure-sensitive button.

17. A method for operating a model vehicle system control comprising:

controlling an aspect of said model vehicle system with a button;

providing more than two outputs of said button depending on a varying of pressure by a user;

applying a first range of pressure to said button to vary a first aspect of a control function;

applying a second range of pressure to said button to vary a second aspect of said control function; and transmitting one of a plurality of signals corresponding to one of said more than two outputs.

18. The method of claim 17 wherein said first and second aspects are reducing a speed applied, and applying brakes, such that brakes are applied only above a certain pressure applied to said button.

19. The method of claim 16 further comprising varying a function controlled by said button in a non-linear manner responsive to variations in pressure.

20. A model vehicle system control apparatus comprising:

a housing;

at least one pressure-sensitive button mounted in said housing for controlling a sound of said model vehicle system;

said button being configured to provide more than two outputs depending on a manner of activation by a user, said outputs providing a non-linear variation to an amount of pressure applied in a sound controlled by said button; and a transmitter, coupled to said button, for transmitting one of a plurality of signals corresponding to one of said more than two outputs.

21. The apparatus of claim 20 wherein a first amount of pressure produces a first sound, and added amounts of pressure produce additional sounds, varying in other than loudness, to provide a combined sound.

22. A model vehicle system control apparatus comprising:

a housing;

at least one analog input mounted in said housing for controlling a boost of a vehicle in said model vehicle system;

said analog input being configured to provide a plurality of outputs depending on a manner of activation by a user, said outputs providing a variation said boost; and a transmitter, coupled to said analog input for transmitting a plurality of signals corresponding to said plurality of outputs.

23. A model vehicle system control apparatus comprising:

a housing;

a pressure sensitive input mounted in said housing for controlling a brake of a vehicle in said model vehicle system;

said pressure sensitive input being configured to provide a plurality of outputs depending on a manner of activation by a user, said outputs providing a variation said brake; and a transmitter, coupled to said pressure sensitive input, for transmitting a plurality of signals corresponding to said plurality of outputs.

24. A model vehicle system control apparatus comprising:

a housing;

at least one analog input mounted in said housing for controlling a sound in said model vehicle system;

said analog input being configured to provide a plurality of outputs depending on a manner of activation by a user, said outputs providing a variation in said sound;

said analog input being configured to produce a distinct, different sound when released, to provide an end sound; and a transmitter, coupled to said analog input, for transmitting a plurality of signals corresponding to said plurality of outputs.

25. The apparatus of claim 24 wherein said end sound is different depending upon the value of the output at the time of release of the analog input.

26. A model vehicle system control apparatus comprising:

a housing;

at least one analog input mounted in said housing for controlling both a movement of a vehicle and a sound corresponding to said movement in said model vehicle system;

said analog input being configured to provide a plurality of outputs depending on a manner of activation by a user, said outputs providing a nonlinear variation of said sound; and a transmitter, coupled to said analog input, for transmitting a plurality of signals corresponding to said plurality of outputs.

27. The apparatus of claim 26 wherein said analog input is a boost input.

28. The apparatus of claim 26 wherein said analog input is a brake input.

29. The apparatus of claim 26 wherein said analog input is a pressure sensitive button.

* * * * *